US007422496B2

(12) United States Patent
Mizutani

(10) Patent No.: US 7,422,496 B2
(45) Date of Patent: Sep. 9, 2008

(54) STEERING SYSTEM FOR SMALL BOAT

(75) Inventor: Makoto Mizutani, Shizuoka-ken (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 0 days.

(21) Appl. No.: 11/515,600

(22) Filed: Sep. 5, 2006

(65) Prior Publication Data

US 2007/0066154 A1 Mar. 22, 2007

(30) Foreign Application Priority Data

Sep. 2, 2005 (JP) ..... 2005-254746

(51) Int. Cl.
*B63H 21/22* (2006.01)

(52) U.S. Cl. ..... 440/1

(58) Field of Classification Search ..... 440/1
See application file for complete search history.

(56) References Cited

U.S. PATENT DOCUMENTS

| | | | |
|---|---|---|---|
| 2,215,003 | A | 9/1940 | Johnson |
| 2,224,357 | A | 12/1940 | Pecker |
| 3,084,657 | A | 4/1963 | Kiekhaefer |
| 3,233,691 | A | 2/1966 | De Biasi |
| 3,310,021 | A | 3/1967 | Shimanckas |
| 3,349,744 | A | 10/1967 | Mercier et al. |
| 4,120,258 | A | 10/1978 | Spurgin |
| 4,220,111 | A | 9/1980 | Krautkremer et al. |
| 4,373,920 | A | 2/1983 | Hall et al. |
| 4,500,298 | A | 2/1985 | Hall et al. |
| 4,519,335 | A | 5/1985 | Krautkremer et al. |
| 4,637,802 | A | 1/1987 | Taguchi et al. |
| 4,787,867 | A | 11/1988 | Takeuchi et al. |
| 4,872,857 | A | 10/1989 | Newman et al. |
| 4,908,766 | A | 3/1990 | Takeuchi |
| 4,909,765 | A | 3/1990 | Riske et al. |
| 5,029,547 | A | 7/1991 | Novey |
| 5,031,562 | A | 7/1991 | Nakase et al. |

(Continued)

FOREIGN PATENT DOCUMENTS

| | | |
|---|---|---|
| JP | 62-166193 | 7/1987 |

(Continued)

OTHER PUBLICATIONS

Co-Pending U.S. Appl. No. 11/075,131, filed Mar. 8, 2005. Now issued as US 7063030 (submitted herewith). Title: Electric Steering Apparatus for Watercraft.

(Continued)

*Primary Examiner*—Stephen Avila
(74) *Attorney, Agent, or Firm*—Knobbe, Martens, Olson & Bear, LLP

(57) ABSTRACT

A steering system for a small boat can include an outboard motor mounted to a hull, a steering wheel operated by a boat operator for steering the boat, a steering angle sensor for detecting a steering angle of the steering wheel, a steering device for moving the outboard motor relative to the hull in response to the steering angle of the steering wheel, and a controller for determining a target steering angle to be achieved by the steering device using the steering angle and steering characteristics. The steering characteristics are determined in response to running conditions.

6 Claims, 10 Drawing Sheets

U.S. PATENT DOCUMENTS

| | | | | |
|---|---|---|---|---|
| 5,231,888 | A | 8/1993 | Katahira | |
| 5,235,927 | A | 8/1993 | Singh et al. | |
| 5,244,426 | A | 9/1993 | Miyashita et al. | |
| 5,253,604 | A | 10/1993 | Bohlin | |
| 5,361,024 | A | 11/1994 | Wisner et al. | |
| 5,370,564 | A | 12/1994 | Fujimoto et al. | |
| 5,533,935 | A | 7/1996 | Kast | |
| 5,800,223 | A | 9/1998 | Iriono et al. | |
| 5,997,370 | A | 12/1999 | Fetchko et al. | |
| 6,079,513 | A | 6/2000 | Nishizaki et al. | |
| 6,230,642 | B1 | 5/2001 | McKenney et al. | |
| 6,234,853 | B1 | 5/2001 | Lanyi et al. | |
| 6,273,771 | B1 | 8/2001 | Buckley et al. | |
| 6,402,577 | B1 | 6/2002 | Treinen et al. | |
| 6,405,669 | B2 | 6/2002 | Rheault et al. | |
| 6,471,556 | B1 | 10/2002 | Yamashita et al. | |
| 6,511,354 | B1 | 1/2003 | Gonring et al. | |
| 6,535,806 | B2 | 3/2003 | Millsap et al. | |
| 6,561,860 | B2 | 5/2003 | Colyvas | |
| 6,655,490 | B2 | 12/2003 | Andonian et al. | |
| 6,671,588 | B2 | 12/2003 | Otake et al. | |
| 6,678,596 | B2 | 1/2004 | Husain et al. | |
| 6,843,195 | B2 | 1/2005 | Watabe et al. | |
| 6,855,014 | B2 | 2/2005 | Kinoshita et al. | |
| 6,892,661 | B2 | 5/2005 | Kishi et al. | |
| 6,892,662 | B2 | 5/2005 | Watanabe et al. | |
| 6,994,046 | B2 | 2/2006 | Kaji et al. | |
| 6,997,763 | B2 | 2/2006 | Kaji | |
| 7,004,278 | B2 | 2/2006 | Sugitani et al. | |
| 2003/0077953 | A1* | 4/2003 | Kaji | 440/1 |
| 2003/0150366 | A1 | 8/2003 | Kaufmann et al. | |
| 2003/0224670 | A1 | 12/2003 | Takada et al. | |
| 2003/0224672 | A1 | 12/2003 | Takada et al. | |
| 2004/0007644 | A1 | 1/2004 | Phelps et al. | |
| 2004/0031429 | A1 | 2/2004 | Kaufmann et al. | |
| 2004/0121665 | A1 | 6/2004 | Mizuguchi et al. | |
| 2004/0139902 | A1 | 7/2004 | Takada et al. | |
| 2004/0139903 | A1 | 7/2004 | Watabe et al. | |
| 2005/0118894 | A1 | 6/2005 | Kawanishi | |
| 2005/0121975 | A1 | 6/2005 | Gronau et al. | |
| 2005/0170712 | A1* | 8/2005 | Okuyama | 440/59 |
| 2005/0170713 | A1 | 8/2005 | Okuyama | |
| 2005/0199167 | A1 | 9/2005 | Mizutani | |
| 2005/0199168 | A1 | 9/2005 | Mizutani | |
| 2005/0199169 | A1 | 9/2005 | Mizutani | |
| 2005/0215131 | A1 | 9/2005 | Oguma et al. | |
| 2005/0282447 | A1 | 12/2005 | Okuyama | |
| 2006/0019558 | A1 | 1/2006 | Mizutani et al. | |
| 2006/0037522 | A1 | 2/2006 | Kaneko et al. | |
| 2006/0180070 | A1 | 8/2006 | Mizutani | |
| 2006/0217012 | A1 | 9/2006 | Mizutani | |
| 2007/0049139 | A1 | 3/2007 | Mizutani | |
| 2007/0066157 | A1 | 3/2007 | Yamashita et al. | |

FOREIGN PATENT DOCUMENTS

| | | | |
|---|---|---|---|
| JP | 02-179597 | | 7/1990 |
| JP | 02-227395 | | 9/1990 |
| JP | 03-148395 | | 6/1991 |
| JP | 04-038297 | | 2/1992 |
| JP | 6-33077 | | 5/1994 |
| JP | 2739208 | B2 | 1/1998 |
| JP | 10-226346 | | 8/1998 |
| JP | A-HEI 10-310074 | | 11/1998 |
| JP | 2959044 | B2 | 7/1999 |
| JP | 01-314695 | | 12/1999 |
| JP | 2000-318691 | | 11/2000 |
| JP | 2003-313398 | | 11/2000 |
| JP | 3232032 | | 9/2001 |
| JP | A-2002-331948 | | 11/2002 |
| JP | A-2004-155282 | | 6/2004 |
| JP | 2005-254848 | | 9/2005 |

OTHER PUBLICATIONS

Co-Pending U.S. Appl. No., filed Oct. 25, 2006. Title: Control Unit for Multiple Installation of Propulsion Units.

Co-Pending U.S. Appl. No., filed Sep. 5, 2006. Title: Steering Method and Steering System for Boat.

Co-Pending U.S. Appl. No., filed Nov. 6, 2006. Title: Electric Type Steering Device for Outboard Motors.

Co-pending U.S. Appl. No. 11/942,179, filed Nov. 19, 2007. Title: Watercraft Steering System, and Watercraft.

Co-pending U.S. Appl. No. 11/942,187, filed Nov. 19, 2007. Title: Watercraft Steering System, and Watercraft.

Co-pending U.S. Appl. No. 11/942,159, filed Nov. 19, 2007. Title: Watercraft Steering Device and Watercraft.

* cited by examiner

STEERING SYSTEM FOR SMALL BOAT

PRIORITY INFORMATION

The present application is based on and claims priority under 35 U.S.C. § 119 to Japanese Patent Application No. 2005-254746, filed on Sep. 2, 2005, the entire contents of which are expressly incorporated by reference herein.

BACKGROUND OF THE INVENTIONS

1. Field of the Inventions

The present invention relates to a steering system for a small boat with a propulsion unit such as outboard motor or stem drive.

2. Description of the Related Art

A steering system for a boat propulsion unit such as outboard motor, is disclosed in Japanese Patent Document JP-B-Hei 6-33077. This steering system is designed to control the delivery amount of hydraulic fluid so as to achieve fast steering movements during low speed (boat speed) operation and slower steering movements during higher speed (boat speed) operation. Boat speed can be detected by a speed sensor provided on the outer bottom surface of the boat.

Variable steering ratio steering systems for automobiles, on the other hand, are disclosed in Japanese Patent Document JP-B-3232032. This steering system is designed such that a target steering angle ratio (ratio of steering wheel movement to change in steering angle of front wheel of vehicle) is adjusted in response to changes in a vehicle speed signal from a vehicle speed sensor. The steering angle ratio is controlled based on the target steering angle ratio and an actual steering angle ratio.

Small boats with outboard motors tend to have certain common steering properties. For example, these boats can be steered by turning the steering wheel which causes the outboard, motor to pivot in a lateral direction, about a vertical shaft, thereby propelling the boat in a direction toward which the outboard motor has been moved. At low boat speeds, thrust is relatively small, and the ratio of a propulsion unit angle (steering angle) to the amount of steering wheel displacement can be increased to deflect the outboard motor by a larger amount relative to the amount of movement of the steering wheel to provide more responsive boat behavior.

These boats are also often countersteered against the wind and tides so as to maintain a straight heading. For example, the steering wheel can be turned by a small amount and held at that position so that the propulsion unit counteracts the forces of the wind or tides, and thus maintain a desired heading.

SUMMARY OF THE INVENTION

An aspect of at least one of the embodiments disclosed herein includes the realization that if the steering angle ratio is set to a large value for low speed operation, when the boat is decelerated from a higher speeds, the steering angle ratio and thus steering angle of the propulsion unit will increase as the boat decelerates to low speed operation, even though the steering wheel is held at a constant position, possibly resulting in an unintended turn.

In addition, when such a boat is accelerated after a turn, the thrust increases which can help the boat turn. The steering angle of the propulsion unit should be promptly returned to 0 degrees after the turn so as to keep the boat in a straightforward direction. However, if the steering angle ratio is set to large value for low speed operation, and since the boat will continue at a low speed immediately after boat operator's accelerator is moved for higher power output as the boat accelerates, the steering angle ratio also remains at the larger value, which can make it more difficult to smoothly transition to a straight ahead heading.

Thus in accordance with an embodiment, a steering system for a small boat can comprise a propulsion unit mounted to a hull, a steering wheel operated by a boat operator for steering the boat and a steering angle sensor configured to detect a steering angle of the steering wheel. A steering device can be configured to move the propulsion unit relative to the hull in response to the steering angle of the steering wheel. A controller can be configured to determine a target steering angle to be achieved by the steering device using the steering angle of the steering wheel and steering characteristics, wherein the steering characteristics are determined in response to running conditions.

In accordance with another embodiment, a steering system for a small boat can comprise a propulsion unit mounted to a hull, a steering wheel operated by a boat operator for steering the boat, and a steering angle sensor for detecting a steering angle of the steering wheel. A steering device can be configured to move the propulsion unit relative to the hull in response to the steering angle of the steering wheel. Additionally, the steering system can comprise means for determining a target steering angle to be achieved by the steering device using the steering angle of the steering wheel and steering characteristics, wherein the steering characteristics are determined in response to running conditions.

In accordance with a further embodiment, a steering system for a boat can comprise a steering unit mounted to a hull, a steering input device configured to be manipulable by a boat operator to allow the boat operator to input steering commands into the steering input device, and a steering input sensor configured to detect steering commands input into the steering input device. A steering device can be configured to move the steering unit relative to the hull. A controller can be configured to determine a target steering angle for the steering device using the detected state of the steering input device, a speed of the boat, and data indicative of acceleration of the boat.

DETAILED DESCRIPTION OF THE PREFERRED EMBODIMENT

Figure 1:
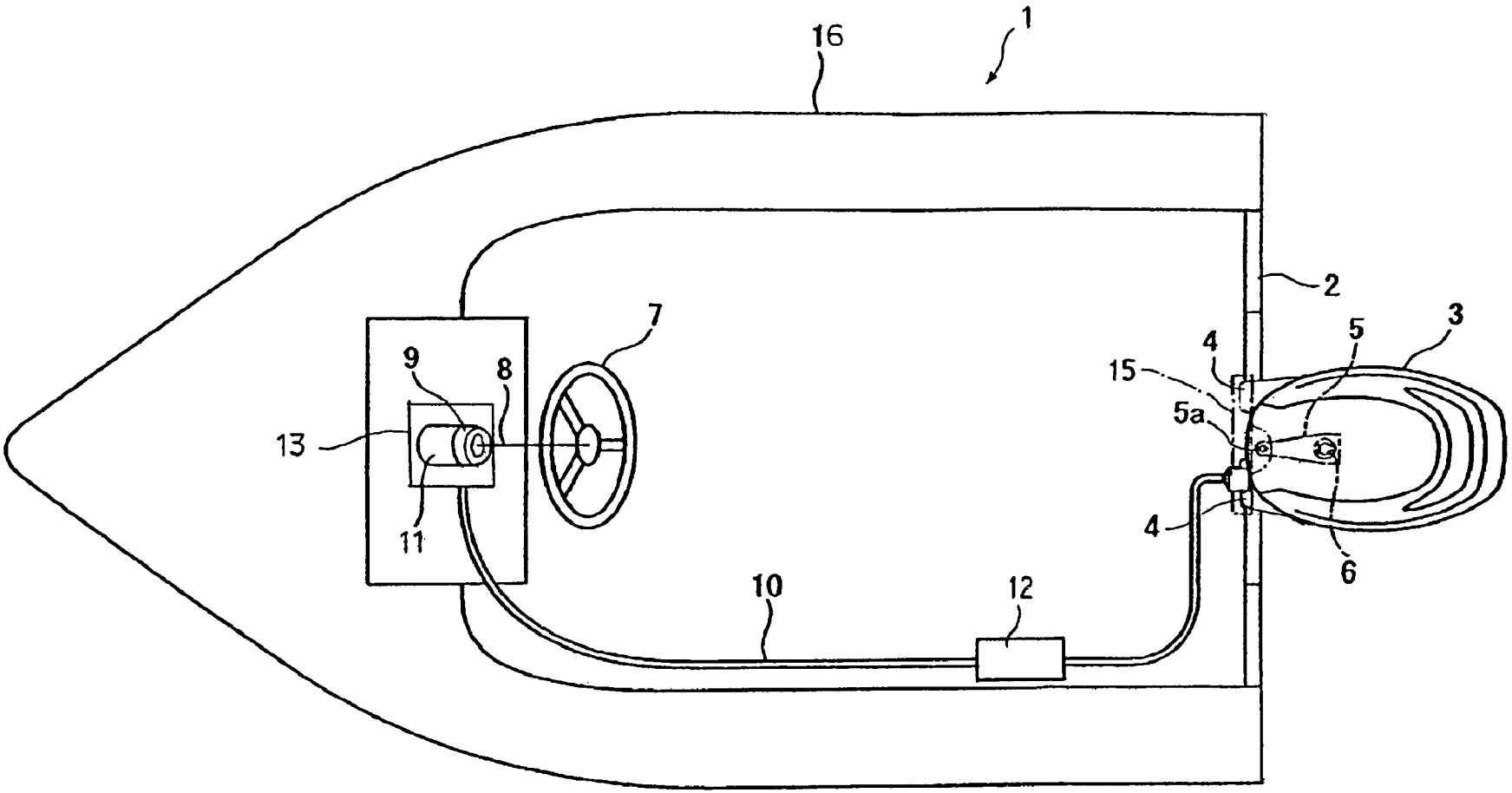
FIG. 1 is a schematic top plan view of a small boat having a steering system in accordance with an embodiment.

FIGS. 1-10 illustrate a steering, system for a boat 1 configured in accordance with certain features, aspects, and advantages of at least one invention described herein. The boat 1 merely exemplifies one type of environment in which the present inventions can be used outboard drive. However, the various embodiments of the steering systems disclosed herein can be used with other types of boats or other vehicles that benefit from improved steering control. Such applications will be apparent to those of ordinary skill in the art in view of the description herein. The present inventions are not limited to the embodiments described, which include the preferred embodiments, and the terminology used herein is not intended to limit the scope of the present inventions.

The small boat 1 can have a hull 16 including a transom plate 2 to which an outboard motor 3 can be mounted through clamp brackets 4. The outboard motor 3 can be pivotable about a swivel shaft (steering pivot shaft) 6 extending substantially in a vertical direction.

The swivel shaft 6 can have an upper end at which a steering bracket 5 can be fixed. The steering bracket 5 can have a forward end 5*a* to which a steering device 15 can be coupled.

The steering device 15 can include, for example but without limitation, a DD (Direct Drive) type electric motor having a motor body (not shown in FIG. 1). The motor body can be adapted to slide along a threaded shaft (not shown in FIG. 1) extending parallel to the transom plate 2. The steering device 15 is described in grater detail below with reference to FIG. 3.

With continued reference to FIG. 1, the forward end 5*a* of the steering bracket 5 can be operatively coupled to the motor body to permit the outboard motor 3 to pivot about the swivel shaft 6 as the motor body can be made to slide.

The boat operator's section of the hull 16 can contain a steering wheel 7 which can serve as a steering input device. A steering control section 13 can be provided at the proximal end of a steering wheel shaft 8 of the steering wheel 8. The steering control section 13 can have a steering angle sensor 9 and a reaction force motor 1. The steering control section 13 can be connected to a controller (ECU) 12 via a signal cable 10. The controller 12 can be connected to the steering device 15.

The controller 12 can be configured to detect the amount of steering wheel displacement by boat operator's steering wheel operation (e.g., a steering input angle) based on a detection signal from the steering angle sensor 9. The controller 12 can also be configured to, using the detected amount of steering wheel displacement and in response to running conditions such as speed and an acceleration/deceleration state, determine a target steering angle to be achieved by the steering device 15. The controller 12 can be configured to transmit a steering angle command signal to the steering device 15 to actuate the DD type motor of the steering device 15 so that the outboard motor 3 pivots about the swivel shaft 6 thereby providing a steering movement toward the target steering angle. A feedback control routine can be used to maintain the outboard motor 3 at or near the target steering angle.

Figure 2:
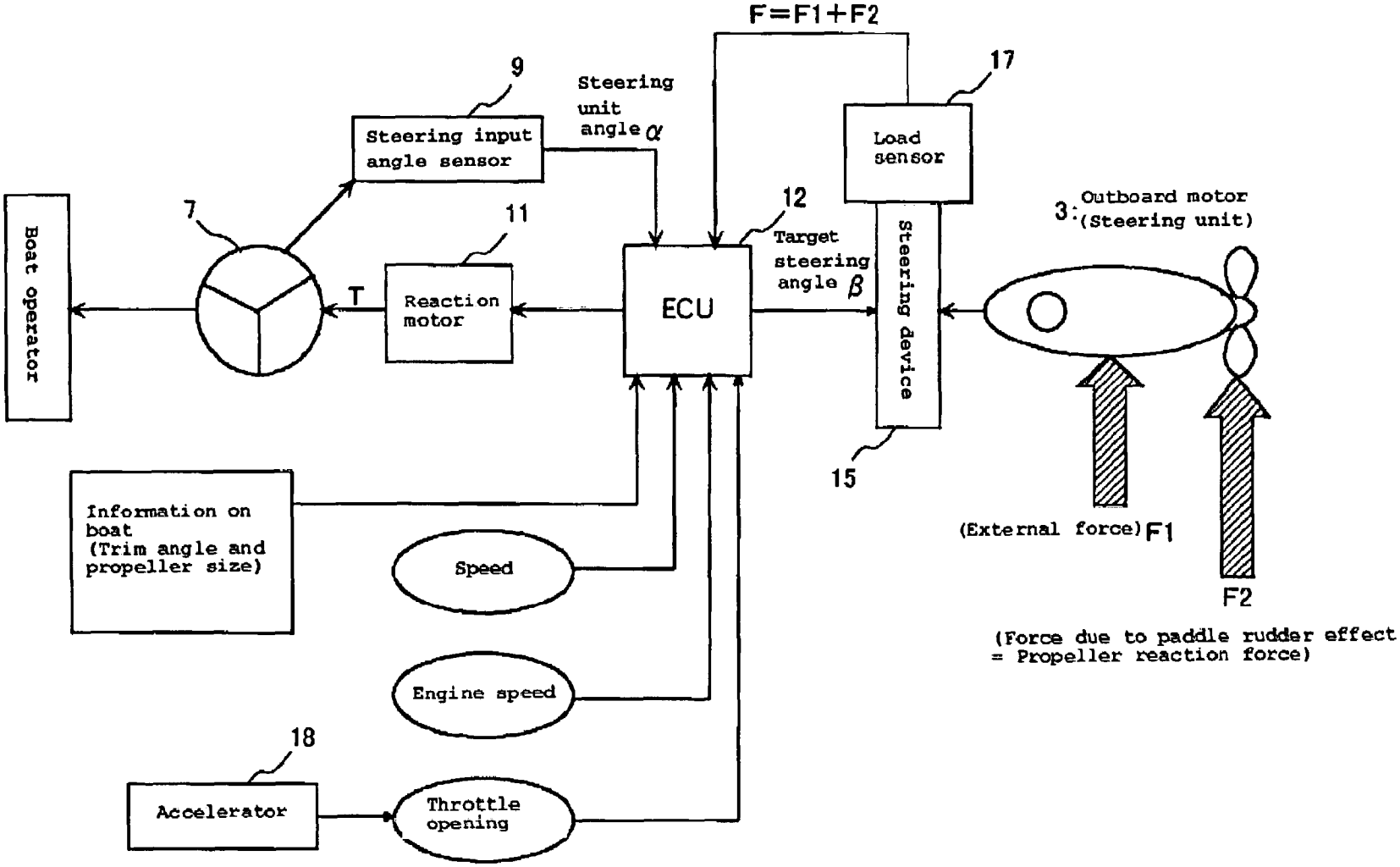
FIG. 2 is a schematic and partial block diagram illustrating a configuration that can be used for the steering system of the boat of FIG. 1.

With reference to FIG. 2, during operation, the outboard motor 3 can experience an external force F1, such as those forces caused by wind or waves, as well as a resistance force against its pivotal movement during steering movements. Also, the outboard motor 3 can experience a propeller reaction force F2 caused by the rotation of the propeller, or a certain deflection force to the propulsion unit (outboard motor 3) to propel the boat in a certain deflected direction (known as the "paddle-rudder" effect).

As the outboard motor 3 is deflected by the steering device 15, a resultant force "F" resulting from the external force F1 and the propeller reaction force F2, acts on the outboard motor 3 and thus acts on the steering device 15. This force F can be referred to as a steering unit moving load acting on the steering device 15. The steering unit moving load "F" (=F1+F2) can be detected by a load sensor 17. The steering unit moving load "F" can be input to the controller 12.

As a boat operator turns the steering wheel 7 to steer the boat, the amount of the steering wheel displacement can be detected by the steering angle sensor 9, and this detection information on the steering input angle $\alpha$ can be input to the controller 12. The controller 12 can also receive an input of information on boat including a trim angle of the outboard motor 3 and a propeller size. Information on speed, engine speed and throttle opening can be also input to the controller 12.

As the boat operator operates an accelerator 18 such as acceleration lever (not shown) so as to accelerate or decelerate, a throttle valve operatively connected to the accelerator opens or closes during a transient operation. The throttle opening during acceleration/deceleration can be detected by a throttle opening sensor (not shown) provided on a throttle shaft. Throttle opening information can be a detection signal from the throttle opening sensor or a detection signal of the amount of accelerator 18 displacement.

The controller 12 can be configured to determine a target steering angle $\beta$ corresponding to the steering input angle $\alpha$ and in response to running conditions determined by the information on boat, running speed, engine speed, throttle opening and steering unit moving load, using predetermined steering characteristics.

Information on engine speed and throttle opening can be used to control operations of the engine, such as ignition timing and fuel injection amount, and thus the engine speed and throttle opening are often continuously monitored for those operations. In some embodiments, a target steering angle $\beta$ can be determined based on such information for engine operation control to determine speed and an acceleration/deceleration state rather than using additional speed sensor or acceleration sensors, thereby reducing the cost of the boat.

The controller 12 can be configured to execute a determination of a target steering angle $\beta$ and engine operation control. The controller 12 can also be configured to execute a determination of a reaction force corresponding to the amount of steering wheel displacement in response to running conditions and external forces and to drive the reaction force motor 11 to apply the determined reaction force to the steering wheel 7 so as to provide an improved boat operation feeling for the operator.

Figure 3:
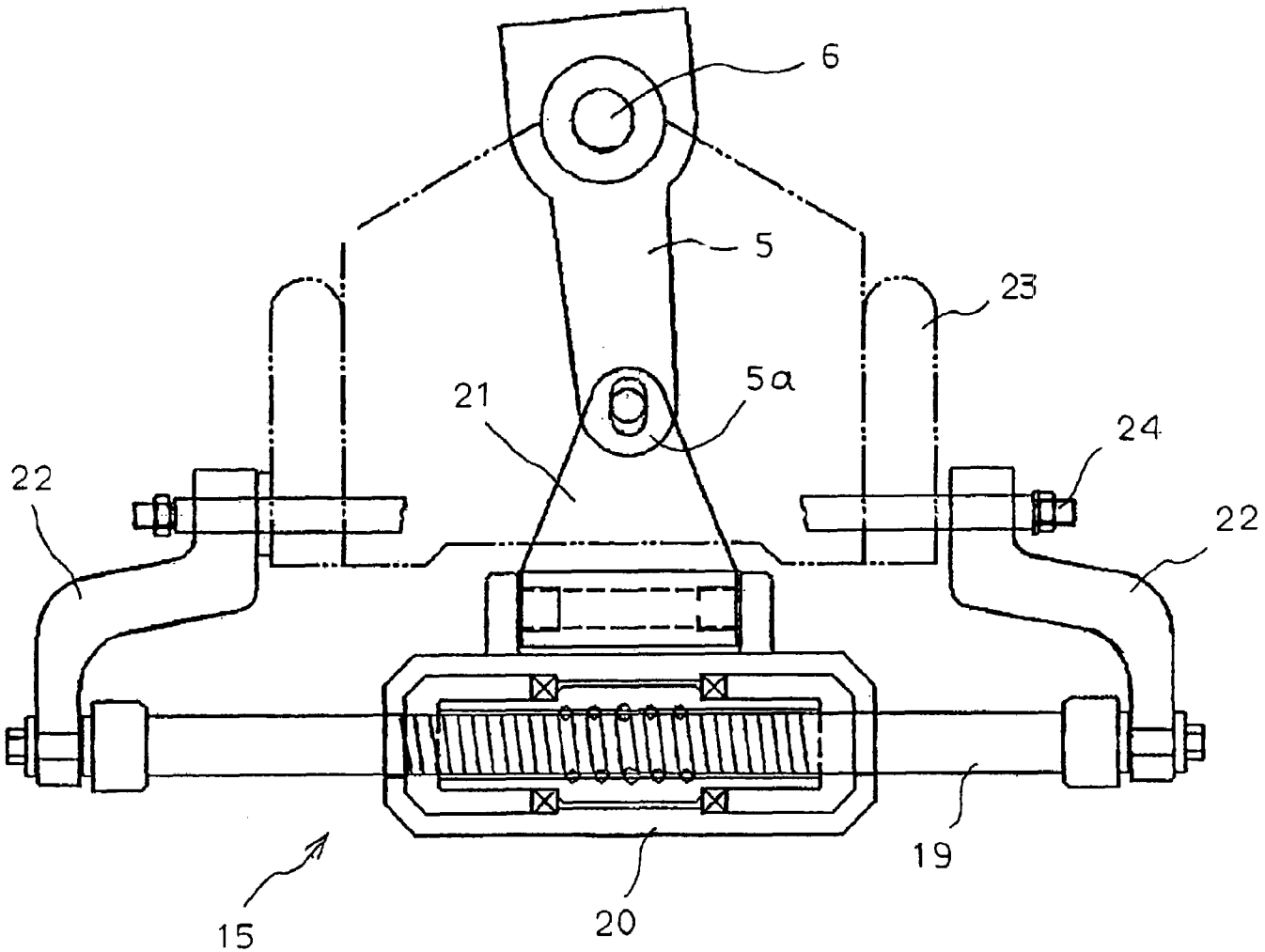
FIG. 3 is a schematic top plan and partial cutaway view of a steering device that can be used with the boat and/or the steering system of FIGS. 1 and 2.
Figure 4:
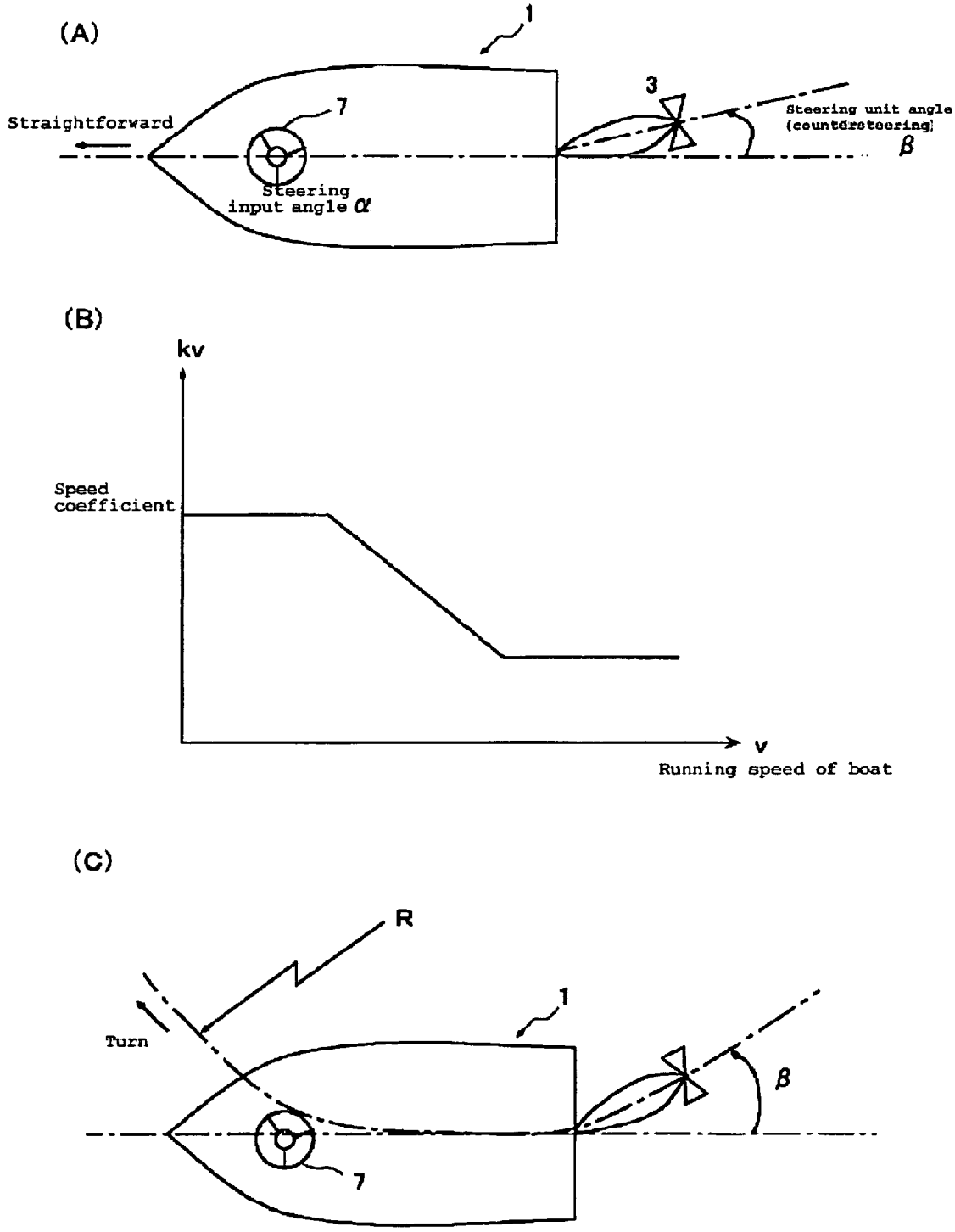
FIGS. 4(A) and 4(C) are schematic top plan views of the boat of FIG. 1 illustrating a change in heading direction from straight ahead operation and to a turning operation in a cross wind.
FIG. 4(B) is a graph illustrating a change in boat speed during the transition from straight ahead operation to a turning operation.

With reference to FIG. 3, the steering device 15 can include an electric motor 20 mounted on a threaded rod 19 and adapted to slide along the threaded rod 19. The threaded rod 19, at its longitudinal ends, can be fixed to the transom plate (not shown) with support members 22. Thus, the threaded rod 19 remains in a fixed position.

Reference numeral 23 denotes a clamp part of the clamp bracket. Reference numeral 24 denotes a tilt shaft 24. The steering bracket 5 can be fixed on the swivel shaft 6 of the outboard motor 3 (see FIG. 1), and the forward end 5*a* of the steering bracket 5 can be coupled to the electric motor 20 through the coupling bracket 21.

In such structure, as the electric motor 20 is driven to slide along the threaded rod 19, which remains in a fixed position, the electric motor 20 pivots the steering bracket 5 and thus pivots the outboard motor 3 about the swivel shaft 6 for steering movement.

FIGS. 4(A), 4(B) and 4(C) illustrate exemplary behaviors of a small boat 1 during deceleration. For example, FIG. 4(A) illustrates the state in which the small boat is traveling straight ahead with countersteering to counteract the forces of a cross wind or current. The steering input angle $\alpha$ of the steering wheel 7 is used to determine the target steering angle $\beta$ of the outboard motor 3. For example, the target steering angle $\beta$ can be computed in response to $\alpha$ so that $\beta=(\alpha)$ can be achieved.

In some embodiments, the target steering angle $\beta$ can be varied in response to a running speed "v" (e.g. target steering angle $\beta$ can be set to be larger for lower boat speed). The following expression can thus be established: $\beta=f(\alpha)\square$ kv, where "kv" is a predetermined speed coefficient corresponding to the speed "v." It should be noted that in normal operation, $\alpha$ can be up to one to two turns of the steering wheel (two turns allowing the steering wheel 7 to move ±360°, totaling 720° from full port to full starboard). The target steering angle $\beta$, on the other hand, can be about ±30° for the maximum turning range of the propulsion unit.

An example of speed coefficients representative of steering characteristics that can be used to determine the target steering angle $\beta$ is shown in FIG. 4(B). As shown in the figure, the speed coefficient "kv" can be smaller for higher speed "v," and larger for lower speed "v." Therefore, in the low-speed range, since the speed coefficient "kv" is large, the target steering angle $\beta$ determined in response to the steering angle $\alpha$ is larger.

When the boat is decelerated while moving in a straight ahead heading and with countersteering, the speed coefficient "kv" increases and thus the target steering angle $\beta$ increases even while the steering input angle $\alpha$ is unchanged. Thus, the boat makes a turn as shown in FIG. 4(C). In this case, a sudden increase in $\beta$ can make the boat 1 turn with a small turning radius "R", which can cause an uncomfortable feeling for the riders of the boat. As described in greater detail below, some o the present embodiments make it possible to prevent reduced such sudden changes in heading to ensure comfortable boat operability.

Figure 5:
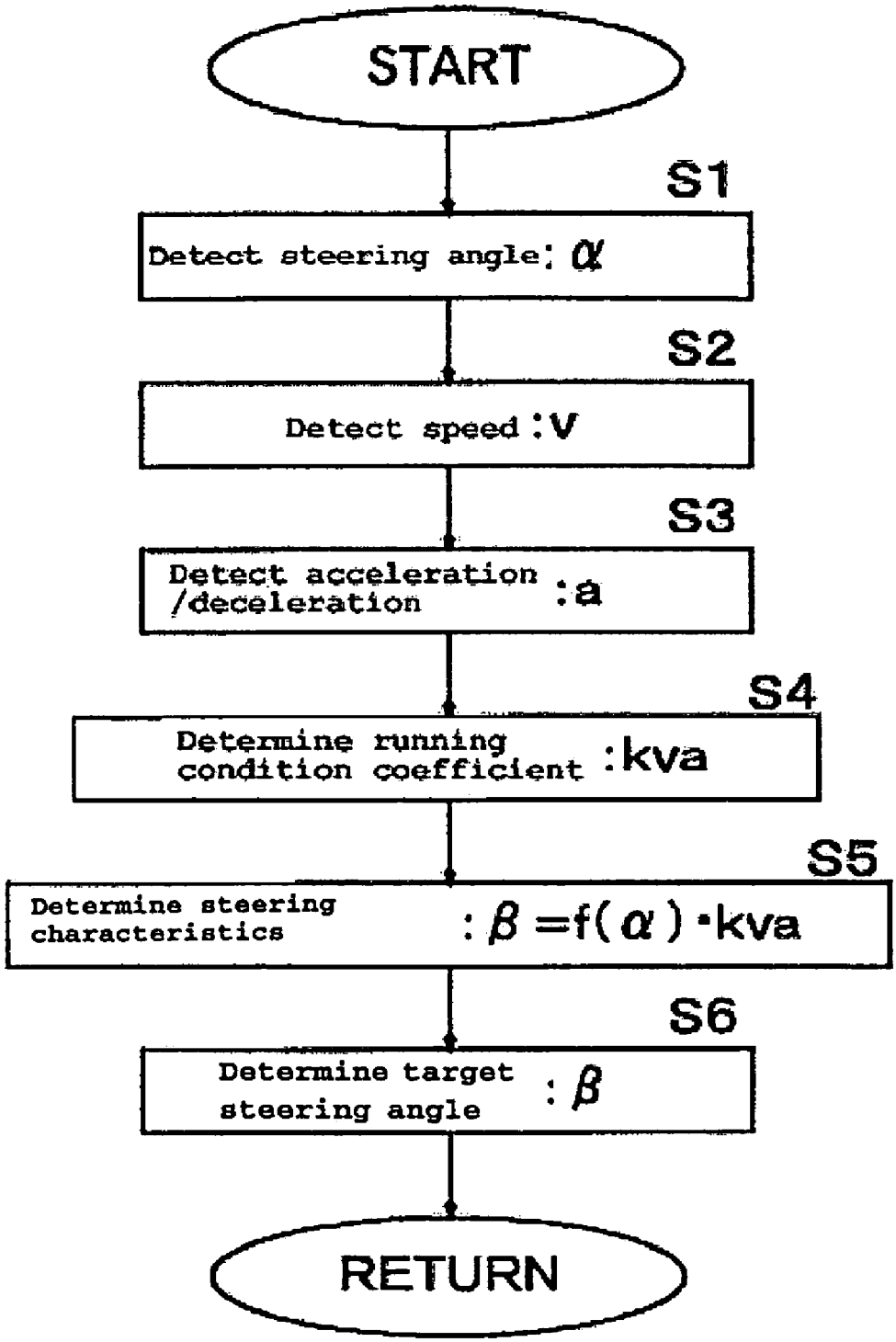
FIG. 5 is a flowchart of the steering operation that can be used during operation of the steering system.
Figure 6:
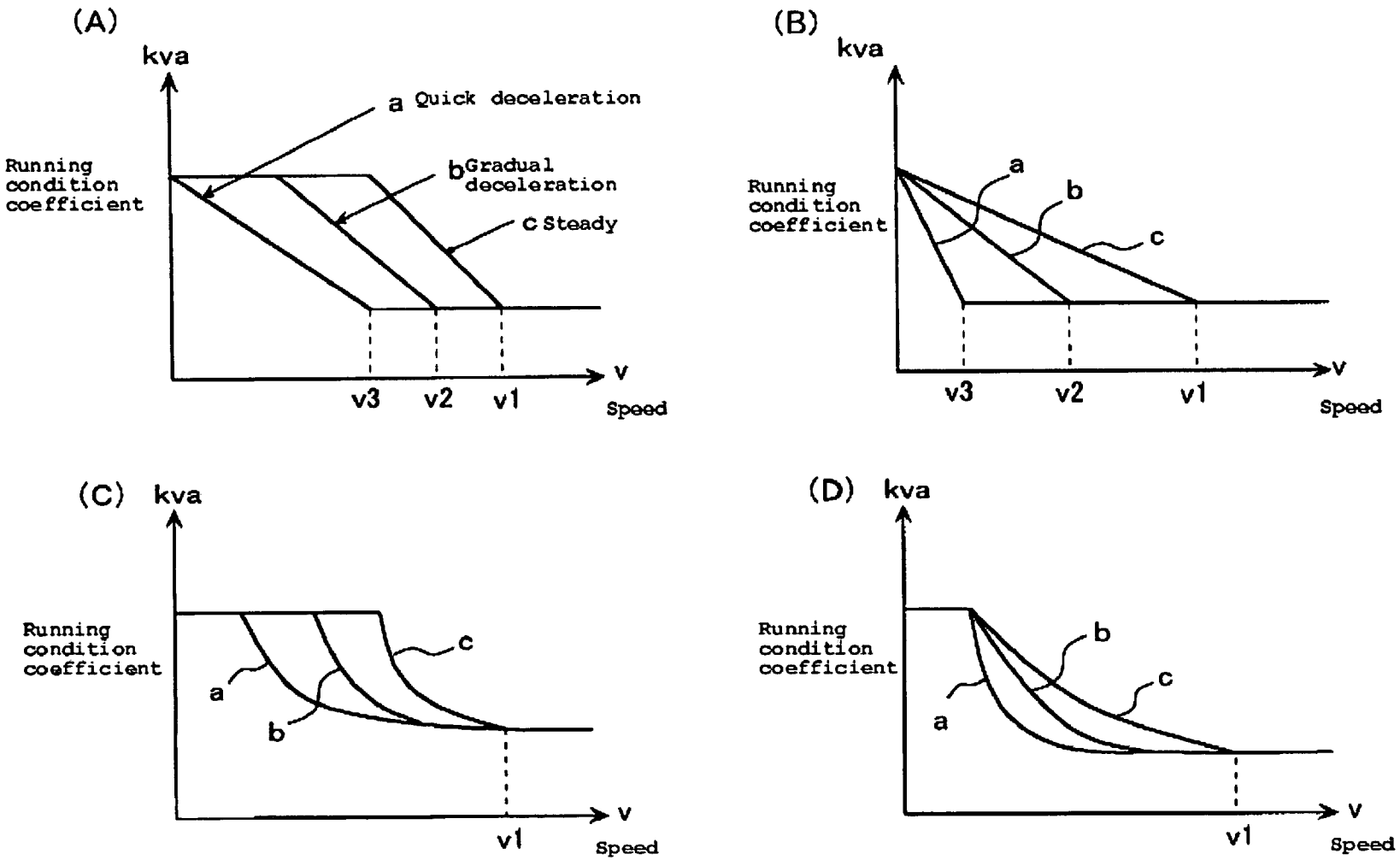
FIGS. 6(A), 6(B), 6(C) and 6(D) are graphs showing exemplary relationships between steering characteristics of the steering system and boat speed.
Figure 7:
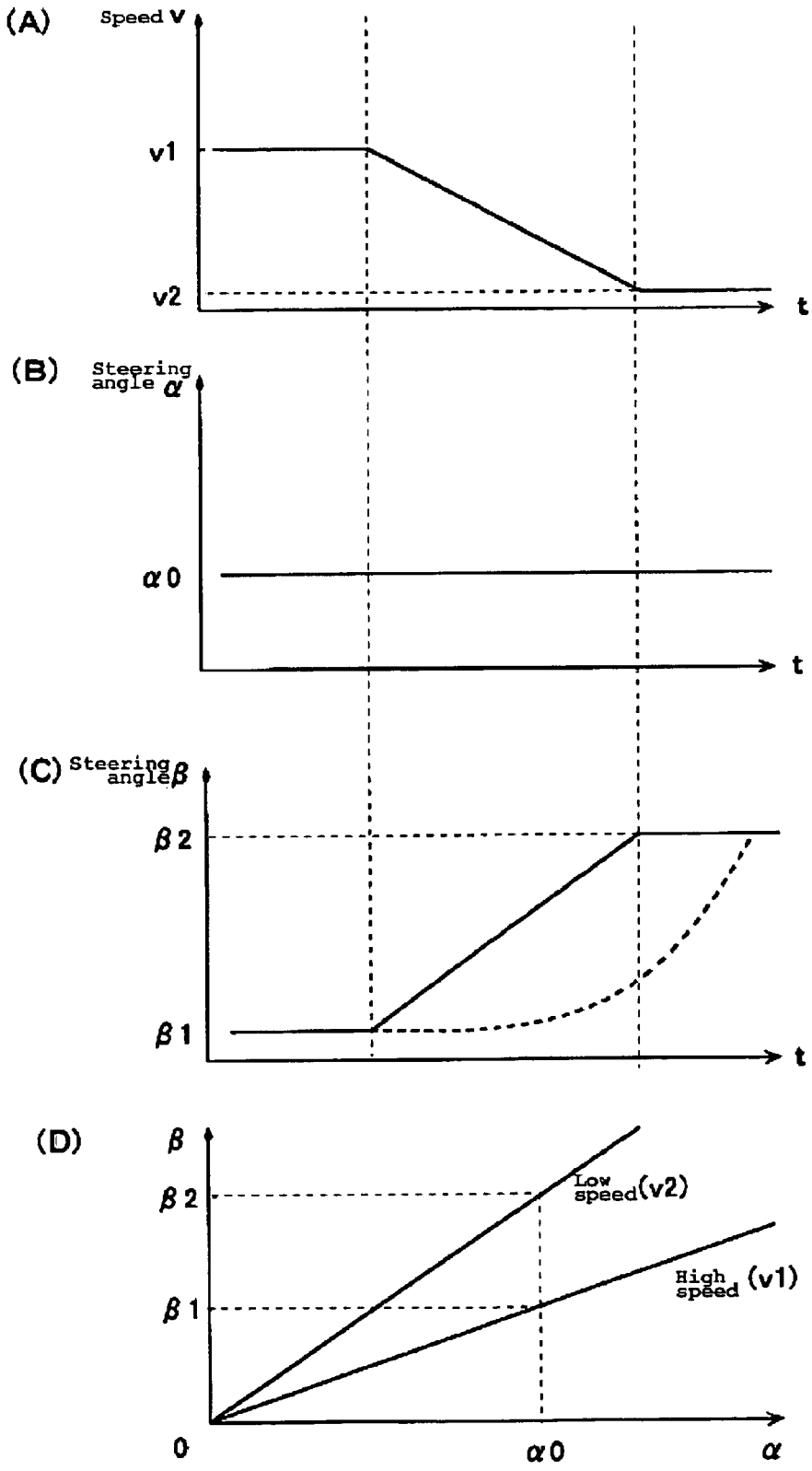
FIGS. 7(A), 7(B), 7(C) and 7(D) are graphs illustrating exemplary changes in the steering angles of the steering system.
Figure 8:
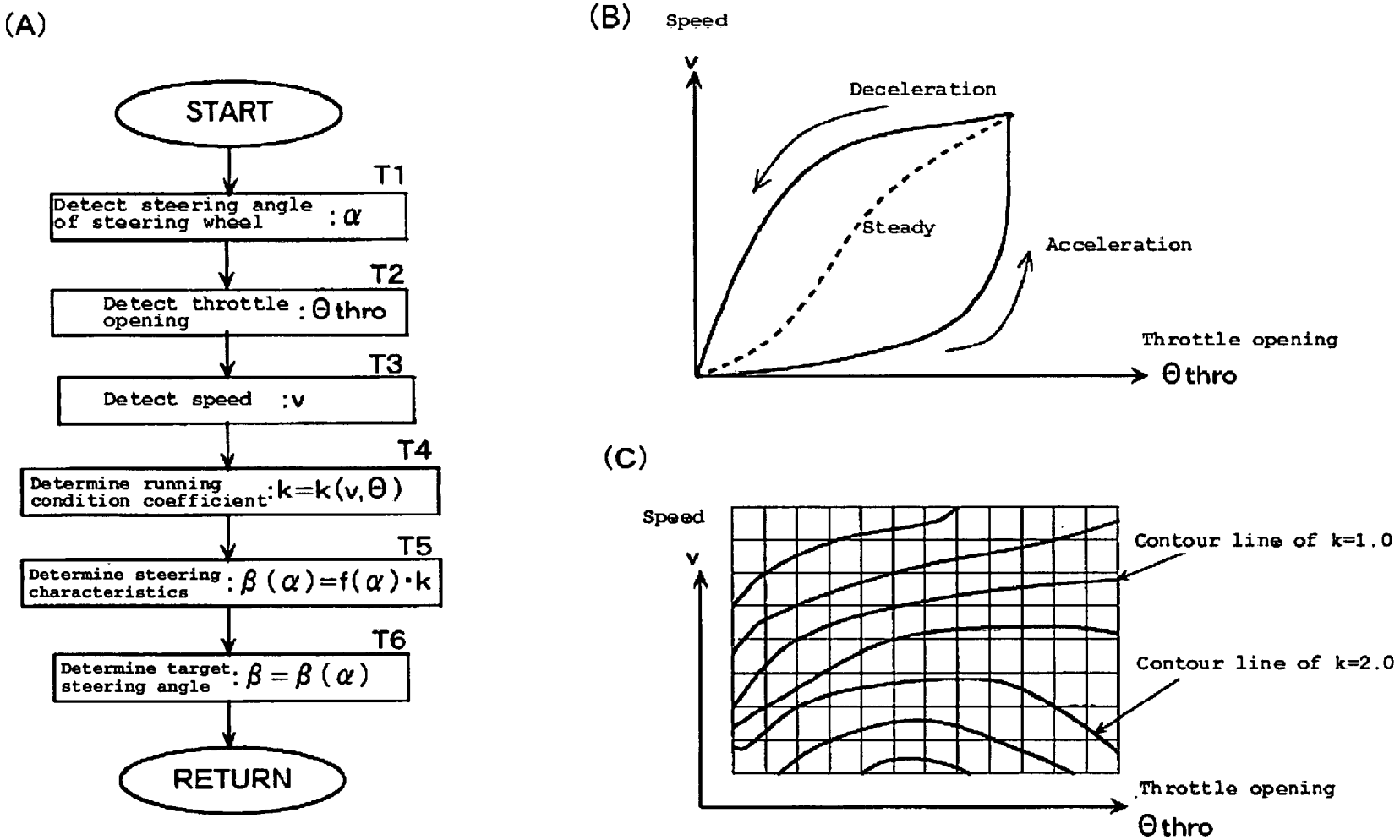
FIG. 8(A) is a flowchart of the steering operation that can be used during operation of the steering system.
FIGS. 8(B) and 8(C) are graphs illustrating exemplary relationships between steering characteristics and throttle opening that can result during execution of the steering operation of FIG. 8(A).
Figure 9:
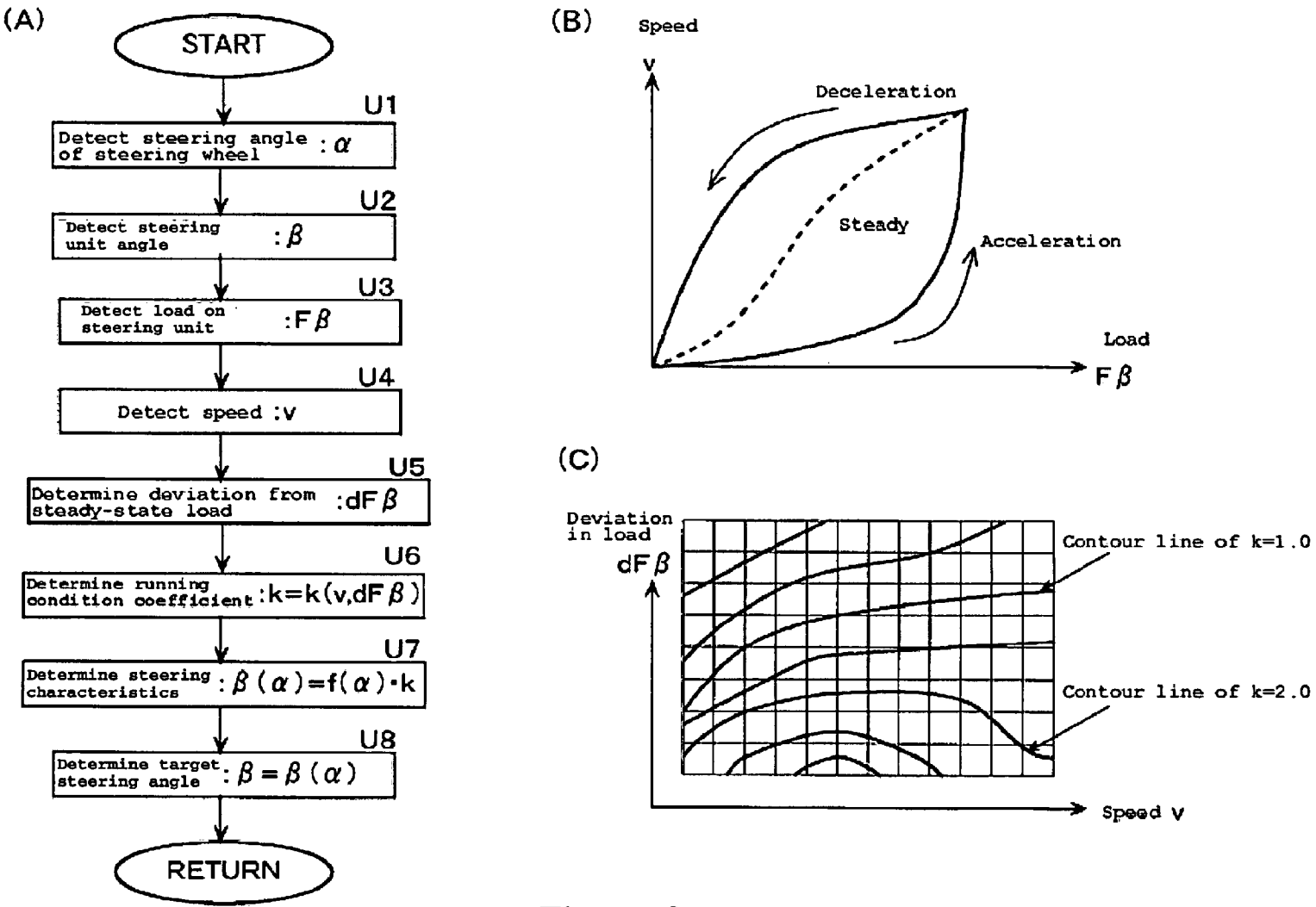
FIG. 9(A) is a flowchart of the steering operation that can be used during operation of the steering system.
FIGS. 9(B) and 9(C) are graphs illustrating exemplary relationships between steering characteristics and steering device load that can result during execution of the steering operation of FIG. 9(A).
Figure 10:
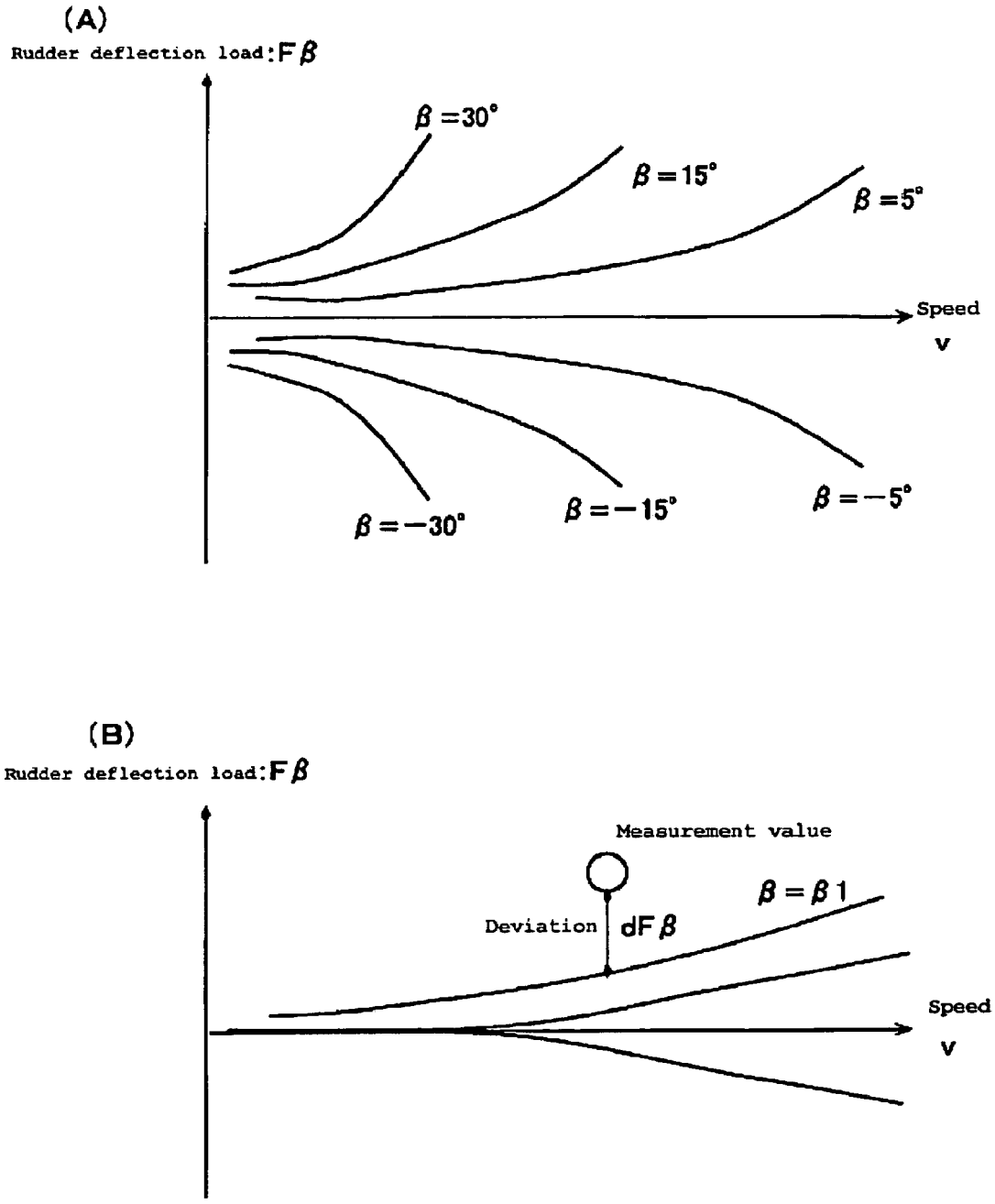
FIGS. 10(A) and 10(B) are graphs illustrating exemplary relationships between boat speed and a load on a steering device that can be used to detect a transient state to an acceleration/deceleration state.

FIG. 5 is a flowchart of a steering operation that can be used for operating the steering system of FIGS. 1-3.

Step S1:

A steering input angle $\alpha$ can be determined. For example, the steering angle sensor 9 (FIG. 2) can be used to detect the amount of steering wheel 7 displacement, or steering input angle $\alpha$, when the steering wheel 7 has been turned. However, other techniques can also be used to determine the steering input angle $\alpha$.

Step S2:

A speed "v" can be detected. The speed "v" can be detected in any of the following methods, although other methods can also be used:

(a) A boat speed sensor can be used. For example, the boat speed sensor can be designed, for example, to detect water speed using the measurement of the rotation of an impeller attached to the outer bottom face of the boat or to detect ground speed using a GPS.

(b) Engine speed can be used. For example, boat speed can be substantially correlated with engine speed, and thus detection of engine speed allows detection of boat speed. Engine speed is often continuously monitored during operation of engines, and thus, such engine speed data is usually input to the controller regardless of the type steering system a boat might have. The use of engine speed data, therefore, permits detection of the speed without the need of additional dedicated boat speed sensor.

(c) A throttle opening or the amount of accelerator displacement can be used. For example, boat speed can be substantially correlated with throttle openings or the amount of accelerator displacement, and thus detection of a throttle opening or the amount of accelerator displacement allows for a detection of boat speed. A throttle opening or the amount of accelerator displacement are often monitored continuously during operation of a boat engine, and thus, such throttle opening or amount of accelerator displacement data are usually input to the associated controller. The use of throttle opening or amount of accelerator displacement data, therefore, permits detection of the speed without the need of additional dedicated boat speed sensors.

(d) Thrust (engine torque) can be used. For example, engine torque can be detected, for example, using a torque sensor provided on a crankshaft. Boat speed can be substantially correlated with thrust, and thus detection of thrust allows detection of speed.

(e) The behavior of the boat can be determined based on a yaw rate, an acceleration or the like, and such behavior can be used. Boat speed and behavior are can be substantially correlated with each other, and thus determination of boat behavior allows detection of speed.

Step S3:

An acceleration "a" indicative of an acceleration/deceleration state of the boat can be detected. The acceleration "a" can be detected in any of the following methods, although other methods can also be used:

(a) A boat speed sensor can be used.

(b) A throttle opening or the amount of accelerator displacement can be used.

(c) A change with time in the speed "v" detected in the step S2 can be used.

(d). A steering unit moving load "F" can be used. The steering unit load "F" can be detected by the load sensor 17 (see FIG. 2).

When an acceleration/deceleration state has been detected, a running condition coefficient "kva" can be determined using a characteristic graph of the running condition coefficient "kva" representative of predetermined steering characteristics in response to the acceleration/deceleration state, as shown in FIG. 6(A). However, other relationships can also be used.

Referring to FIG. 6(A), symbol "a" denotes a quick deceleration state, "b" a gradual deceleration state, and "c" a steady state. In the steady state "c," "kva" can be set to increase at a speed "v1" or lower so as to increase the target steering angle β. An example shown in FIG. 6(A) is the same as the example in FIG. 4(B) described above.

In the example in FIG. 6(A), in the gradual deceleration state "b," "kva" begins to increase at a speed "v2" that can be lower than the speed "v1". In the quick deceleration state "a," "kva" begins to increase at an even lower speed "v3." In such manner, varying the speed at which "kva" begins to increase depending on a deceleration state can prevent an unintended turn when the boat is decelerated in a straightforward state with countersteering as described with reference to FIG. 4(C). In this case, the speed at which "kva" begins to increase can be shifted to the low-speed side for quicker deceleration (larger negative acceleration). In the steering characteristics in deceleration states denoted by symbols "a," "b" and "c," changes in speed from the respective speeds "v1," "v2" and "v3" are not limited to the example shown in FIG. 6(A) but may be set to be larger in the order of "c," "b" and "a" as shown in FIG. 6(B).

FIG. 6(C) illustrates an example of further improved steering characteristics. In this example, the steering characteristics of FIG. 6(A) described above are used but increases in "kva" are performed more smoothly in the respective deceleration states "a," "b" and "c," and specifically, changes in "kva" are small on the high-speed side. According to this example, an intended turn can be restrained further reliably when the boat is decelerated in a straightforward state with countersteering. Centrifugal force caused by the turn can be thereby reduced, and thus, a change in lateral acceleration to the boat and the boat operator is decreased, so that a steadier and thus more comfortable riding feeling can be provided. In this case, in the same manner as in FIG. 6(B), the steering characteristics may be set to have larger changes in "kva" in the order of "c," "b" and "a" as shown in FIG. 6(D), on the contrary to FIG. 6(C).

With reference again to FIG. 5, after the Step S3, the routine can move to a Step S4.

Step S4:

A running condition coefficient "kva" can be determined using the steering characteristics shown in FIG. 6(A), 6(B) or 6(C).

Step S5:

An operational expression to determine a target steering angle β can be established. The expression can be $\beta=f(\alpha)\square$ kva.

Step S6:

The target steering angle β can be determined by the operational expression established in step S5. The steering device 15 (see FIG. 15) can be actuated in response to the determined target steering angle β. Additionally, a feedback control routine, or other technique, can be used to maintain the outboard motor 3 at the target steering angle β.

The process of steps S1 through S6 described above can be repeated at predetermined time intervals.

FIGS. 7(A), 7(B), 7(C) and 7(D) are timing diagrams illustrating changes in the steering angle of the steering system over time according to some embodiments. For example, FIG. 7(A) illustrates changes in the speed "v" over time "t." In this example, speed v is decreased from "v1" to "v2."

FIG. 7(B) illustrates the steering angle α of the steering wheel. In this example, the steering angle α does not change. Rather, the boat 1 is moving straight ahead with countersteering, with the steering angle α kept at α0.

FIG. 7(C) illustrates a change in the target steering angle β over time. The solid line indicates the steering characteristics shown in FIG. 6(A) described above as they change with time. For example, as the speed shifts from a high speed (v1) to a low speed (v2), the running condition coefficient "kva" increases, so that the target steering angle β increases from β1 to β2. The dotted line indicates the steering characteristics shown in FIG. 6(C) described above as they change with time. For example, a change in β on the high-speed side in the early stage of the deceleration can be reduced, thereby preventing an abrupt turn.

FIG. 7(D) indicates, the graphs of FIG. 7(A) through 7(C) as relationships between the steering angle α and the target steering angle β. As shown in the figure, when the steering angle α is at α0, the target steering angle β can be a relatively small value β1 at the high speed "v1," and as the speed decreases to the low speed "v2," the target steering angle β increases to β2.

FIG. 8(A) is a flowchart of steering characteristics determination procedures using a throttle opening. This procedure can begin with a Step T1.

Step T1:

A steering input angle α can be determined. For example, the steering angle sensor 9 (FIG. 2) can be used to detect the amount of steering wheel 7 displacement, or steering input angle α, when the steering wheel 7 has been turned. However, other techniques can also be used to determine the steering input angle α.

Step T2:

A throttle opening θthro can be detected. For example, the throttle opening can be detected using a throttle opening sensor (not shown) provided on a throttle shaft or the amount of displacement of an accelerator such as remote control lever. However, other techniques can also be used.

Step T3:

A speed "v" can be detected (see the method (c) with reference to step S2 in FIG. 5 described above).

Exemplary relationships between running conditions and throttle openings are illustrated in FIG. 8(B). The dotted line indicates when the boat 1 maintains a substantially steady speed, showing hysteresis during acceleration when the throttle opening increases and during deceleration when the throttle opening decreases. For example, the boat speed does not increase immediately after the throttle valve is opened for acceleration, resulting in a delayed increase in speed. On the other hand, immediately after the throttle valve is closed for deceleration, the speed remains at a higher speed due to inertial force, resulting in a delayed decrease in speed. Such relativity between the throttle opening and the speed on the hysteresis characteristics permits determination of an acceleration/deceleration state using a detection value of the throttle opening.

Step T4:

A running condition coefficient "k" can be determined by a three-dimensional map based on throttle openings and speed as shown in FIG. 8(C). For example, detection of, a throttle opening and speed allows determination of the running condition coefficient "k" by the corresponding coordinates on the map.

Step T5:

The relational expression of the target steering angle β to the steering input angle α can be established as follows:

$$\beta(\alpha)=f(\alpha)\cdot k$$

Step T6:

The target steering angle β can be determined using the relational expression established in step T5. The process of steps T1 through T6 described above can be repeated at predetermined time intervals.

FIGS. 9(A), 9(B) and 9(C) are views to explain steering characteristics determination using a steering unit load.

FIG. 9(A) is a flowchart of steering characteristics determination procedures. This procedure can begin with a Step U1

Step U1:

A steering input angle α can be determined. For example, the steering angle sensor 9 (FIG. 2) can be used to detect the amount of steering wheel 7 displacement, or steering input angle α, when the steering wheel 7 has been turned. However, other techniques can also be used to determine the steering input angle α.

Step U2:

The actual or current steering angle β can be detected. For example, the actual steering angle β can be detected using a steering unit angle sensor (not shown) provided in the steering device 15.

Step U3:

A steering unit load Fβ can be detected. For example, the load sensor 17 (see FIG. 2) can be used to detect a steering unit load Fβ.

Step U4:

A boat speed "v" can also be detected. The boat speed can be detected in any of the speed detection methods described above with reference to step S2 in FIG. 5.

Step U5:

The load detected in step U3 can be compared with a certain steady-state load to determine a deviation therefrom. An acceleration/deceleration state can be thereby detected. For example, as shown in FIG. 9(B), an increase in load during acceleration does not cause an immediate increase in speed, and the speed continues to be below the speed indicated by a steady-state graph. On the other hand, a decrease in load during deceleration does not cause an immediate decrease in speed due to inertial force, and the speed continues to be above the speed indicated by the steady-state graph. That is, the graph of load to speed characteristics has hysteresis characteristics as shown in FIG. 9(B). Therefore, the determination of a deviation of the detected load from the certain steady-state load allows determination of an acceleration/deceleration state.

Step U6:

The running condition coefficient "k" can be determined, for example, by a three-dimensional map based on speed and deviations in load as shown in FIG. 9(C). However, other techniques can also be used. In some embodiments, the detection of speed and a deviation in load allows determination of the running condition coefficient "k" by the corresponding coordinates on the map.

Step U7:

The relational expression of the target steering angle β to the steering input angle α can be established:

$$\beta(\alpha)=f(\alpha)\cdot k$$

Step U8:

The target steering angle β can be determined using the relational expression established in step U7.

The process of steps U1 through U8 described above can be repeated at predetermined time intervals.

FIGS. 10(A) and 10(B) are graphs illustrating exemplary relationships between boat speed and a load on a steering device that can be used to detect a transient state to an acceleration/deceleration state.

FIG. 10(A) is a graph illustrating relationships among speed, steering unit angles and steering unit loads in a steady state. As is clear from this figure, the load Fβ increases as the target steering angle β increases, but the speed dose not increase beyond a certain limit.

FIG. 10(B) is a graph illustrating a deviation of an actual detection value from a certain steady-state value when the target steering angle β is β1. In the characteristics graph of β=β1, when a detection value is larger than a certain steady-state value with a deviation dFβ, an acceleration state can be determined by the deviation. This can also be seen from the graph of FIG. 9(B) described above. In FIG. 9(B), at a certain speed, when the detected load can be higher than a certain steady-state load, an acceleration state can be determined, whereas when the detected load can be smaller, a deceleration state can be determined.

What is claimed is:

1. A steering system for a small boat comprising a propulsion unit mounted to a hull, a steering wheel operated by a boat operator for steering the boat, a steering angle sensor configured to detect a steering angle of the steering wheel, a steering device configured to move the propulsion unit relative to the hull in response to the steering angle of the steering wheel, and a controller configured to determine a target steering angle to be achieved by the steering device using the steering angle of the steering wheel and steering characteristics, wherein the steering characteristics are determined in response to running conditions, wherein the running conditions comprise at least speed and an acceleration or deceleration state, and wherein the acceleration or deceleration state is detected using a steering unit load to the steering device.

2. A steering system for a small boat comprising a propulsion unit mounted to a hull, a steering wheel operated by a boat operator for steering the boat, a steering angle sensor configured to detect a steering angle of the steering wheel, a steering device configured to move the propulsion unit relative to the hull in response to the steering angle of the steering wheel, and a controller configured to determine a target steering angle to be achieved by the steering device using the steering angle of the steering wheel and steering characteristics, wherein the steering characteristics are determined in response to running conditions, wherein the running conditions comprise at least speed and an acceleration or deceleration state, and wherein the steering characteristics are determined such that a change in target steering angle to the speed becomes smaller for higher speed.

3. A steering system for a boat comprising a steering unit mounted to a hull, a steering input device configured to be manipulable by a boat operator to allow the boat operator to input steering commands into the steering input device, a steering input sensor configured to detect steering commands input into the steering input device, a steering device configured to move the steering unit relative to the hull, and a controller configured to determine a target steering angle for the steering device using the detected state of the steering input device, a speed of the boat, and data indicative of acceleration of the boat, and wherein the controller is configured to determine the target steering angle in accordance with at least a first relationship between steering input commands and target steering angle for lower boat speeds and a second relationship between steering input commands and target steering angle for higher boat speeds.

4. A steering system for a boat comprising a steering unit mounted to a hull, a steering input device configured to be manipulable by a boat operator to allow the boat operator to input steering commands into the steering input device, a steering input sensor configured to detect steering commands input into the steering input device, a steering device configured to move the steering unit relative to the hull, and a controller configured to determine a target steering angle for the steering device using the detected state of the steering input device, a speed of the boat, and data indicative of acceleration of the boat, and wherein the controller is configured to delay the transition between the first and second relationships based on the acceleration of the boat.

5. A steering system for a boat comprising a steering unit mounted to a hull, a steering input device configured to be manipulable by a boat operator to allow the boat operator to input steering commands into the steering input device, a steering input sensor configured to detect steering commands input into the steering input device, a steering device configured to move the steering unit relative to the hull, and a controller configured to determine a target steering angle for the steering device using the detected state of the steering input device, a speed of the boat, and data indicative of acceleration of the boat, and wherein the controller is configured to change the determination of the target steering angle from the first relationship to the second relationship at a threshold boat speed, and to change the threshold boat speed depending on the acceleration of the boat.

6. A steering system for a boat comprising a steering unit mounted to a hull, a steering input device configured to be manipulable by a boat operator to allow the boat operator to input steering commands into the steering input device, a steering input sensor configured to detect steering commands input into the steering input device, a steering device configured to move the steering unit relative to the hull, and a controller configured to determine a target steering angle for the steering device using the detected state of the steering input device, a speed of the boat, and data indicative of acceleration of the boat, and wherein the controller determines the acceleration of the boat based on at least one of a throttle valve position, a throttle lever of the boat, a load on the steering unit, and a change in boat speed.

* * * * *

UNITED STATES PATENT AND TRADEMARK OFFICE

CERTIFICATE OF CORRECTION

PATENT NO. : 7,422,496 B2
APPLICATION NO. : 11/515600
DATED : September 9, 2008
INVENTOR(S) : Makoto Mizutani It is certified that error appears in the above-identified patent and that said Letters Patent is hereby corrected as shown below:

On the title page, on Page 2, Column 2, Item (56), Line 21, under Foreign Patent Documents, please change "12/1999" to --12/1989--

In Column 1, Line 37, please change "board," to --board--

In Column 3, Line 21, please change "steering," to --steering--

In Column 3, Line 58, please change "motor 1." to --motor 11.--

In Column 5, Line 29, please change "$\beta=(\alpha)$" to --$\beta=f(\alpha)$--

In Column 8, Line 12, please change "indicates," to --indicates--

In Column 8, Line 59 (Approx.), please change "of," to --of--

Signed and Sealed this

Eleventh Day of August, 2009

David J. Kappos

David J. Kappos
*Director of the United States Patent and Trademark Office*